US006167984B1

(12) United States Patent
Johansson et al.

(10) Patent No.: US 6,167,984 B1
(45) Date of Patent: Jan. 2, 2001

(54) DEVICE AND A METHOD FOR SOUND REDUCTION IN A TRANSPORT SYSTEM FOR GASEOUS MEDIUM AND USE OF THE DEVICE IN AN EXHAUST SYSTEM FOR SHIPS

(75) Inventors: Claes-Göran Johansson, Västerås; Örian Götmalm, Kullavik, both of (SE)

(73) Assignee: ABB Flakt AB, Stockholm (SE)

( * ) Notice: Under 35 U.S.C. 154(b), the term of this patent shall be extended for 0 days.

(21) Appl. No.: 09/331,365

(22) PCT Filed: Dec. 18, 1997

(86) PCT No.: PCT/SE97/02143

§ 371 Date: Aug. 13, 1999

§ 102(e) Date: Aug. 13, 1999

(87) PCT Pub. No.: WO98/27321

PCT Pub. Date: Jun. 25, 1998

(30) Foreign Application Priority Data

Dec. 19, 1996 (SE) ..... 96046644

(51) Int. Cl.[7] ..... F01N 7/02
(52) U.S. Cl. ..... 181/232; 181/252; 181/255
(58) Field of Search ..... 181/232, 249, 181/250, 252, 255, 256, 258, 282

(56) References Cited

U.S. PATENT DOCUMENTS 2,826,261 3/1958 Eckel .
2,855,068 10/1958 Chapel .
3,807,527 * 4/1974 Bergson et al. ..... 181/232
4,371,054 2/1983 Wirt .
5,726,397 * 3/1998 Mukai et al. ..... 181/232

FOREIGN PATENT DOCUMENTS 4412517 10/1995 (DE) .
0093923 11/1983 (EP) .
2122256 1/1984 (GB) .

* cited by examiner

*Primary Examiner*—Khanh Dang
(74) *Attorney, Agent, or Firm*—Pollock, Vande Sande & Amernick

(57) ABSTRACT

A device and a method for achieving sound reduction within a frequency band in a transport system for gaseous medium, the transport system being arranged between an inlet, which is connected to a sound source, and an outlet. The transport system comprises with a plurality of interconnected channel parts (1–7) and exhibits at least one module (8, 9) comprising at least one reflection attenuator (4) with a resistive length ($a_2$, $b_2$) and at least one reactive attenuator (3) with a reactive length ($a_1$, $a_3$, $b_1$, $b_3$). The resistive length is brought to constitute a quarter of a wavelength of the center frequency of the frequency band and the reactive length is brought to constitute a quarter of a wavelength of a frequency between, respectively, the lower and upper limit frequencies of the frequency band.

19 Claims, 2 Drawing Sheets

DEVICE AND A METHOD FOR SOUND REDUCTION IN A TRANSPORT SYSTEM FOR GASEOUS MEDIUM AND USE OF THE DEVICE IN AN EXHAUST SYSTEM FOR SHIPS

FIELD OF THE INVENTION

The present invention relates to a device and a method for sound reduction in a transport system for gaseous medium The gas transport system is primarily intended for an exhaust system arranged in an internal-combustion engine of a ship, whereby the noise generated from the outlet of the exhaust system is to fulfil certain predetermined requirements with respect to sound. However, the invention may be advantageously applied also to ventilation plants, exhaust gas plants in, for example, vehicles with internal-combustion engines, or flue gas cleaning devices for plants for production of electric power.

BACKGROUND OF THE INVENTION

For the purpose of reducing the sound which is emitted especially from the orifice of a ventilation system or an exhaust system, it is known to arrange one or more sound attenuators in the gas channel of the system. The term "sound attenuator" usually means a device with the ability to consume sound energy. This can take place by the sound energy being transformed into some other energy form, such as, for example, heat, the energy of which may be diverted and cooled. As discussed below, the term "resistive attenuator" constitutes a device in a gas channel which is capable of absorbing sound, that is, of transforming the sound energy into another energy form. The term "attenuator", as raised herein, means an apparatus which is capable of reducing sound, and attenuation means the property of reducing sound.

One typical embodiment of a resistive attenuator is a round or square tube, the sides of which, exposed to the gas flow, are coated with an absorbent or a porous medium of small coupled cavities. A common such sound attenuator intended for a ventilation system is described in patent document GB 2,122,256. From the patent 2,826,261, another resistive attenuator intended for an exhaust system is previously known. As absorbent there is usually used mineral wool or glass wool including some adhesive which causes the absorbent to have a bonded structure. The absorbent may also be protected by an air-permeable surface layer, for example a perforated plate, to attain greater service life and better mechanical stability at high gas speeds. Such a resistive attenuator will have a sound-attenuating property which covers a wide frequency range and is dependent, besides on the thickness and the rate of flow of the absorbent, also on the length and the inner area of the attenuator.

The ratio of the absorbent thickness to the length of the acoustic waves which are part of the sound is determining for the attenuation at lower frequencies. A satisfactory attenuation is achieved for sound frequencies at which the thickness of the absorbent is larger than a quarter of a wavelength of the sound. The sound attenuation properties then decrease drastically for sound of lower frequencies which has a greater wavelength. Even when the ratio of the wavelength to absorbent thickness is about 1/8, the absorption is only half as great, and at the ratio 1/16 it is only 20% of the absorption which is obtained at the ratio 1/4. Since a certain absorption capacity still remains, in many cases a sufficient absorption may be obtained by increasing the length of the total absorbent in the gas transport system. Also, the cross-section area of the gas transport system is of importance for the sound reduction obtained since the reduction in the upper frequency range of the sound decreases with increased cross-sectional area.

A problem with the resistive attenuator is thus that the absorbing layer must be made thick to be able to absorb low frequencies. This entails a large volume. A smaller absorbent thickness may, however, be compensated by a larger total length of the attenuator. This leads to an increased cost of the sound reduction obtained. Another problem is that the pressure reduction in the system must be limited. This leads to a relatively large cross-section area of the system. The sound reduction at the upper frequency range of the sound is thus reduced. The sound-attenuating properties are also dependent on where in the system the sound attenuator is placed. It often appears that the properties which are obtained in a laboratory, especially at low frequencies, and which are described in pamphlets, are seldom obtained in practice. This leads to a great oversizing in order to ensure a sufficient sound attenuation.

Another known way of reducing the sound emission from a gas transport system is to prevent the sound from propagating in the channel. This can be achieved by arranging reactive obstacles in the gas channel. One such obstacle is obtained by creating a sound which is out of phase with the sound in the channel, whereby extinction occurs. This technique is used preferably in connection with so-called active sound attenuation. The oppositely directed sound is then created by a loudspeaker placed in the channel. However, extremely controllable conditions are required in order for an active system to function.

One further way of reducing the sound which reaches the orifice is to arrange an obstacle to the progressing acoustic wave in the channel. This type of sound attenuator actually consumes no energy and is usually named reactive attenuator. A reactive attenuator substantially operates according to two principles. The first type is a reflection attenuator. This comprises an increase of the cross-sectional area, whereby the area increase gives rise to a reflection wave which propagates in a direction opposite to the propagation of the sound. From a functional point of view, the obstacle may be regarded as a wall, from which the sound rebounds. The second type of abstacle is a resonance attenuator, which influences the propagation of the sound in a channel. In this case, the obstacle may be regarded as a pitfall, into which the progressing sound falls on its way towards the orifice.

Resonance sound attenuators comprise two main types, namely, quarter-wave attenuators and so-called Helmholtz resonators. The latter is tuned to one frequency only, whereas a quarter-wave attenuator is tuned to a certain tone but also influences its odd harmonics. The quarter-wave attenuator usually comprises a closed pipe which is connected to the channel and which corresponds to a quarter wavelength of the sound to be attenuated. Its attenuating properties usually cover a very narrow frequency range. One problem with a reactive attenuator is that the volume must be tuned to the frequency of the sound to be prevented. Another, and much more difficult, problem to overcome with regard to a reactive attenuator is that it is very sensitive to where it is located in the system. By regarding the sound as something that propagates in steps and the obstacle as a pitfall, into which the progressing sound is to fall, it is easily realized that it is important to place the orifice of the pitfall correctly in relation to the length of step. An incorrectly placed pitfall implies that the sound may step over without resistance. To obtain a maximum attenuating effect, the orifice of the quarter-wave attenuator must thus be placed in a pressure maximum of the sound field in the channel.

There are also a great number of devices which in various ways combine the methods mentioned above. However, the problem is usually that the various comnponents end up in different locations where they are not effective. To compensate for the unforeseeable properties, conventional sound attenuator systems are often greatly oversized, which leads to expensive, heavy and space-demanding plants with high pressure drops.

Sound attenuator devices in transport systems for gas, where the gas changes temperature, implies further complications since the wavelength of the sound is changed with the temperature. If the temperature of the gas is increased from 20° C. to 900° C., the sound velocity and hence the wavelength increase twofold. An attenuator which operates well at normal temperature therefore suffers deteriorated properties, especially at low frequencies when the gas is heated. This usually results in sound attenuating devices in transport systems with hot gases becoming very bulky. An additional problem in gas transport systems for hot gases is the risk of condensation formation. The sound absorbent in the sound attenuator usually exhibits thermal insulation, in which case the inside of the sound attenuator becomes so cold that liquids dissolved in the hot gas condense here. The condensed liquids are able to transform combustion residues transported in the gas, such as sulphur compounds and hydrocarbons, into acid which corrodes metal,among other things. Condensation may also lead to accumulation of particles in the system.

SUMMARY OF THE INVENTION

The object of the present invention is to produce a transport system for gas, from which the sound emission is less than from conventionally known systems and which does not suffer from the above-mentioned disadvantages. The transport system shall be simpler, less space-demanding, have a small cross-section area and be less expensive to manufacture than corresponding systems manufactured using known technique. The system shall have a smaller weight and exhibit a smaller pressure drop and less generation of aerodynamic sound inside the channel than conventional systems and be able to comprise system components such as exhaust gas boiler, spark arrester, amoung others. The sound-reducing effect shall be capable of being tuned with respect to the acoustic boundary conditions present in the system and be less sensitive to frequency variations. Since the transported gases are often hot, the system shall include a heat insulation such that the channels on the outside may be contacted but such that no condensation is formed on the inside of the system. The system shall also be simple to maintain and comprise replaceable parts.

This is achieved according to the invention by a transport system, intended for a gaseous medium and by a method described below. Advantageous embodiments are also described.

Sound propagates in a gas as a translational movement, whereby the molecules of the gas alternately become dense and dispersed. This results in relative pressure maxima and pressure minima. When a sound source is brought to sound in a room, a sound field arises, which is caused by the acoustic boundary conditions which characterize the room. It may be said that the room gives a response to the sound source. The sound field is built up of air molecules which in certain positions move very vigorously whereas the molecules in other positions move very little, or are even stationary. In those positions where the molecules are stationary, the relative air pressure is high, and in those positions where the velocity of the molecules is great, the relative air pressure is low. For each sound frequency, a pattern arises which is more or less accentuated depending on the boundary conditions of the room and how strongly the sound at that very frequency is generated by the sound source. In the following text, the above-mentioned pressure minima are referred to as nodes. Between the nodes, the sound field assumes an oscillation mode, the oscillating movement of which is referred to as amplitude.

In an exhaust system, where the gases are passed through a channel towards an orifice, a sound field arises in the same way as in a room, which sound field is determined by the boundary conditions in the channel. In addition, there is a clearly expressed direction of movement of the sound energy itself, namely from the sound source to the orifice. The acoustic boundary conditions, to which the sound is subjected on its way towards the orifice, are thus determined by the properties of the limiting surfaces of the channel. Not least at the orifice are the acoustic boundary conditions complicated, since the very shape of the orifice, as well as the phenomenon that hot gas at a high pressure is thrown out into air at normal temperature and normal atmospheric pressure, influence the sound generation. At the orifice, the progressing sound is subjected to a strong reflection, whereby part of the sound energy passes in the opposite direction. The reflected sound gives rise to a sound field with standing waves in the channel. In an unattenuated channel system, the sound field is determined almost exclusively by these reflection waves. Standing waves with pronounced nodes and great amplitudes are thus imparted to the generated sound field.

By introducing attenuation in the channel system, the sound field becomes less accentuated. Experiments have shown that under such conditions it is possible to locally control the sound field generated in the channel. Each area increase causes a reflection wave where part of the progressing sound energy bounces back. In an attenuated elongated channel system, this means that, at such an area increase, a node in the sound field is located. The present invention makes use of this in such a way that the position of the node is used for determining an optimum length of a reflection attenuator which may include also resistive attenuation properties and the best location of the orifice of a reactive attenuator.

To limit the volume of the gas transport system, resistive attenuators with moderate absorbent thicknesses are arranged in the channel system. A good sound attenuation is thus obtained for sound of high frequencies. For sound of lower frequency, a good sound attenuation is also obtained by arranging a plurality of resistive attenuators one after the other. The inferior absorption capacity is thus compensated for by a larger overall length of resistive attenuators.

At low frequencies, the progressing wave interprets a resistive attenuator more as a reflection attenuator. Since the channel system is attenuated, the sound field is arranged such that a node in the sound field is located at the area transition. Consequently, to obtain a good attenuating effect at a certain frequency of the sound, a quarter-wave attenuator is thus to be placed with its orifice in a position which is a quarter of a wavelength away from the area increase. Between two nodes of a sound of a certain frequency, the distance is half a wavelength. Midway between these nodes, that is, at the distance a quarter of a wavelength from the node, the pressure amplitude is greatest. In this position, the gas molecules move the least, and here the orifice of a quarter-wave attenuator is placed. The method described also makes it possible to optimally arrange the quarter-wave attenuator to an extent coinciding with that of the channel.

By a suitable combination of reflection attenuators with resistive attenuation properties and reactive attenuators, experiments have shown that the sound field in the channel may be controlled and that, by the choice of location, attenuators with predictable, optimized attenuating properties may be constructed. When locating a reactive attenuator on either side of a reflection attenuator, experiments have shown that at low frequencies, a considerable attenuation effect with a bandwidth corresponding to a third octave band may be achieved. A third band comprises one-third of an octave and corresponds to a bandwidth of about 24% of the center frequency.

BRIEF DESCRIPTION OF THE DRAWINGS

The invention will be explained in greater detail by description of an embodiment with reference to the accompanying drawing, wherein.

DESCRIPTION OF THE PREFERRED EMBODIMENT

Figure 1:
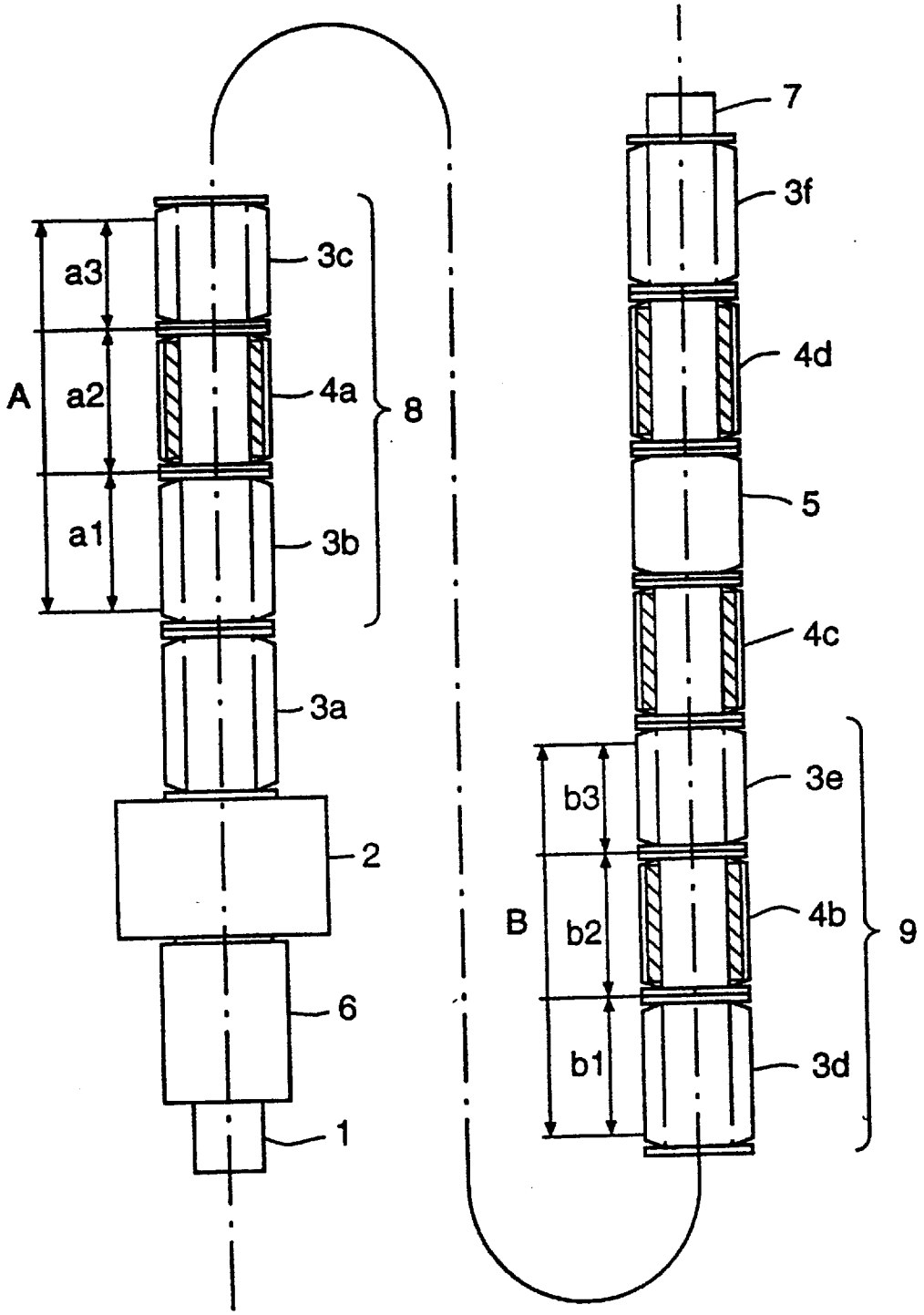
FIG. 1 shows a transport system composed of resistive and reactive attenuators according to the invention.

A transport system according to the invention intended for gaseous medium is shown in FIG. 1. The transport system shown is an exhaust system for a diesel engine on a ship. Exhaust gases from an engine (not shown) are passed through an inlet pipe 1, placed in the lower part of the exhaust system, via a flue gas cleaning plant 6, to a heat exchanger 2. In this, part of the surplus heat of the hot gas is taken out for heating water or oil. The gases are passed from the heat exchanger further through a sound-reducing part of the exhaust gas channel which comprises a plurality of reactive sound attenuators 3 and a plurality of resistive reflection attenuators 4, which comprise some form of sound absorption. In the upper part of the exhaust system, the exhaust gases are passed through a spark arrester 5 to an outlet pipe 7 which is connected to an orifice (not shown) surrounded by a smoke stack (not shown). The gases transported in the channel are hot and usually have a temperature of about 400° C. With the gases, minor combustion particles are transported, which, upon condensation of liquids dissolved in the gas, form acids which may cause corrosion damage on, among other things, metal.

The sound-attenuating part of the exhaust system is, according to the invention, designed with an outer diameter with a uniform thickness. This results in a slender channel system with a uniform thickness, which permits the exhaust system to be accommodated within an optimum space-saving overall volume. The resistive reflection attenuators 4 included in the system are intended to efficiently absorb sound at the high and medium frequency ranges. The sound absorption capacity then drops with decreasing frequency. However, a sufficient absorption is obtained also for the upper part of the lower frequency range by the arrangement of a large number of resistive reflection attenuators in the channel. The sound-reducing effect of a conventional, space-demanding channel system is compensated, according to the invention, instead by a larger total length with resistive attenuation.

At low frequencies, the resistive reflection attenuators 4 function as reflection attenuators only, in which case the sound energy for certain frequencies is reflected in a direction opposite to the sound propagation. The sound field in the channel thereby adapts itself such that in that position in the channel where the cross-sectional area is changed, a pressure node is located in the sound field. This is utilized according to the invention in such a way that the orifice of a reactive attenuator 3 is arranged at a distance of a quarter of a wavelength from the pressure node thus defined. The reason is that a reactive attenuator functions best if its orifice is placed where the acoustic pressure is greatest, which it is half-way between two nodes, that is, at a distance of a quarter of a wavelength from one of the nodes.

For a quarter-wave attenuator, the length of the attenuator is the same as the length between the reflection attenuator and the orifice of the quarter-wave attenuator. This permits the quarter-wave attenuator to advantageously be given an extent parallel to the pipe and with its closed end towards the reflection attenuator. The exhaust gas channel may thus be designed with an outer diameter of uniform thickness. The length of the quarter-wave attenuator is thus just as large as the distance between the edge of the reflection attenuator and the orifice of the quarter-wave attenuator. This length will hereinafter be referred to as the reactive length and thus includes both the distance of the orifice from the reflection attenuator and the length of the quarter-wave attenuator.

A reflection attenuator has an attenuation characteristic which gives high attenuation for frequencies, whose even multiples of a quarter of a wavelength correspond to the length of the attenuator. The attenuating effect then decreases upwards and downwards in the frequency range and approaches zero for frequencies, whose multiple of half a wavelength corresponds to the length of the attenuator. This pattern results in the reflection attenuator being effective at a fundamental frequency, the wavelength of which is four times the length of the attenuator, and at even harmonics to this fundamental frequency. At low frequencies, it is thus the reflecting properties of the resistive reflection attenuator that are utilized. The resistive length is therefore identical with the length of the reflection attenuator and will hereinafter be referred to as the resistive length. It should be mentioned here that the resistive attenuator at low frequencies can be equally replaced by a reflection chamber or some other unit in the exhaust system which exhibits a change in area.

A resonance attenuator absorbs within a narrow frequency range. The attenuation characteristic of the quarter-wave attenuator is related to odd multiples of a quarter of a wavelength of the sound. The attenuating effect then decreases very rapidly upwards and downwards in the frequency range. One condition for a quarter-wave attenuator to give an attenuating effect at all is that its orifice is placed in the system such that the resonance movement is started. This is done effectively only when the orifice is located at a point in the sound field where the frequency concerned has a pressure maximum. The quarter-wave attenuator is used preferably for attenuating pure tones in the system. Thus, if it is placed a quarter of a wavelength from a reflection attenuator, its effect becomes optimal. When placing it before or after a resistive attenuator, its sound-reducing capacity and bandwidth at low frequencies may be optimized by a suitable choice of resistive length and reactive length.

Experiments have shown that a module of three sound-attenuator units exhibits exceedingly effective sound-attenuating properties in the low-frequency range. Sound within a fairly wide frequency band may in this way be effectively attenuated. According to the invention, the attenuators are arranged in modules 8 and 9, respectively, which comprise at least one resistive reflection attenuator 4 and at least one reactive attenuator 3. FIG. 1 shows two modules, each with a resistive reflection attenuator 4 surrounded by a reactive attenuator 3, arranged on either side, with the orifice facing away from the reflection attenuator. The total extent A and B, respectively, of such a module is three unit lengths a and b, respectively, each comprising three-quarters of the wavelength of the center frequency of the frequency band within which the attenuation is to be achieved. The reactive attenuator 3*b* and 3*d*, respectively, which is placed first in the flow direction is adapted to be tuned to the lower limit frequency of the frequency band. The reactive attenuator 3*c* and 3*e*, respectively, placed after the resistive reflection attenuator is adapted to be tuned to the upper limit frequency of the frequency band. The resistive length $a_2$ and $b_2$, respectively, is adapted to correspond to a quarter of a wavelength of the center frequency mentioned. The reactive length $a_1$ and $b_1$, respectively, is adapted to correspond to a quarter of a wavelength of the lower limit frequency. The reactive length $a_3$ and $b_3$, respectively, is adapted to correspond to a quarter of a wavelength of the upper limit frequency.

In case of a desired attenuating function corresponding to a frequency band of the magnitude of a third band, the band-width is about 24% of the center frequency. To attain such an attenuating function, the reactive lengths are adapted to correspond to a quarter of a wavelength of the frequencies which are, respectively, 12% below and 12% above the center frequency of the third octave band. The resistive length $a_2$ and $b_2$, respectively, shown in FIG. 1 corresponds to a quarter of a wavelength of the center frequency of the third octave band. The reactive length $a_1$ and $b_2$, respectively, corresponds to the resistive length $a_2$ and $b_2$, respectively, multiplied by the factor 1.14. In a corresponding way, for the upper limit frequency, the reactive length $a_3$ and $b_3$, respectively, is equal to the resistive length $a_2$ and $b_2$, respectively, divided by the factor 1.14. Experiments have shown that an attenuation of about 15 dB over a frequency band comprising a third octave band is attained with the module described. A synergy effect is achieved when interconnecting two modules, in which case the modules cooperate such that the total sound-reducing effect extends over a whole octave band, that is, three third octave bands. This is thus achieved without a resistive reflection attenuator placed between the modules.

Figure 2:
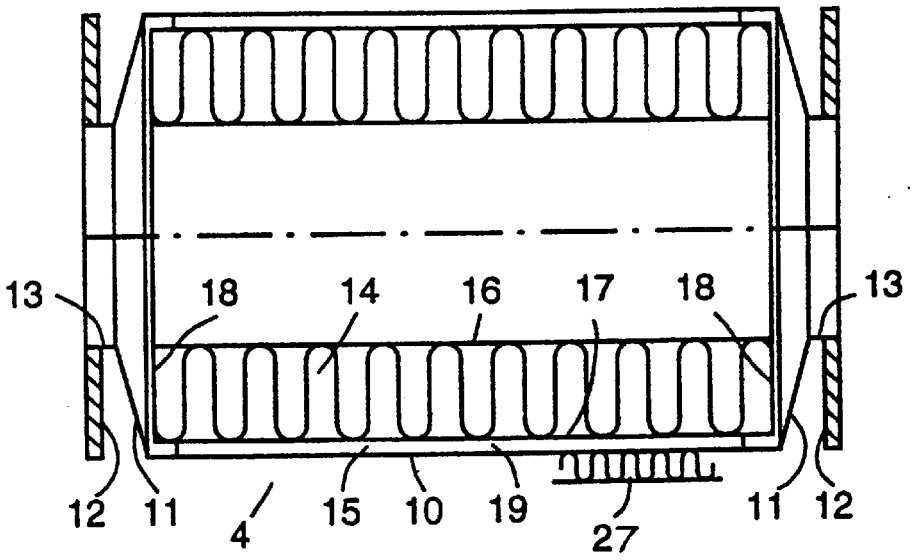
FIG. 2 shows a cross section of a resistive attenuator.

A resistive reflection attenuator 4 included in the transport system is shown in FIG. 2. The sound attenuator comprises a cylindrical container 10 with a cone-shaped connection piece 11 arranged at each end, to which is fixed a preferably circular flange 12 for connection with a connecting unit in the system. The container 10, the connection piece 11 and the flange 12 are made of a heat-resistant material such as metal and preferably of stainless steel. A cylindrical absorption body 14, forming a passageway coinciding with the inside 13 of the flange 12, is arranged in the container. Between the inside of the container and the outside of the absorption body, a channel 15 for passage of a gas is arranged, the channel extending in a cross section along the whole inside of the container. A temperature safety protection means 27 is arranged on the outside of the container. The temperature safety protection means is suitably designed as a heat-insulating coating with an outer dirt-repelling, mechanically resistant surface.

The absorption body 14 comprises a cylinder body of a heat-resistant sound absorbent, preferably a wool with long fibers, which is compressed between an inner protective layer 16 and an outer protective layer 17. The sound absorbent may, for example, be made of glass or mineral wool, but also other ceramic or synthetic fibers may be used. The inner protective layer 16 and the outer protective layer 17, which surround the absorbent, are joined together at the ends by circular end portions 18. Between the end portion 18 and the opposite inner side of the connection piece 11 at the respective end of the container, an orifice and an outlet to the channel 15 are arranged. The protected absorbent is centered and fixed in the container by a plurality of longitudinally extending spacing sticks 19, attached to the inside of the container. The inner and outer protective layers are arranged to partially expose the absorbent and are made of a heat-resistant material. The protective layers are preferably made of a perforated stainless sheet or a corrosion-resistant netting. Experiments have shown that the introduction of the channel 15 traversed by gas does not entail any significant deterioration of the sound absorption. Sound-reducing properties corresponding to an absorbent thickness between the inside of the container 10 and the inner protective layer 16 of the absorbent may thus be largely expected.

The task of the channel 15 arranged on the inside of the container 10 is to permit the passage of a partial amount of the hot exhaust gases flowing through the sound attenuator. By this passage of hot gases, a temperature of 150° C. is obtained on the inside of the container, whereby it may be prevented that liquids dissolved in the gas are condensed on the inside of the container. The inside thus heated must be heat-insulated such that no personal injury arises upon contact with the system from the outside. A temperature of 55° C. is therefore aimed at. For that reason, the temperature safety protection means 27 is arranged so as-to achieve a temperature-safe outside of the system.

Figure 3:
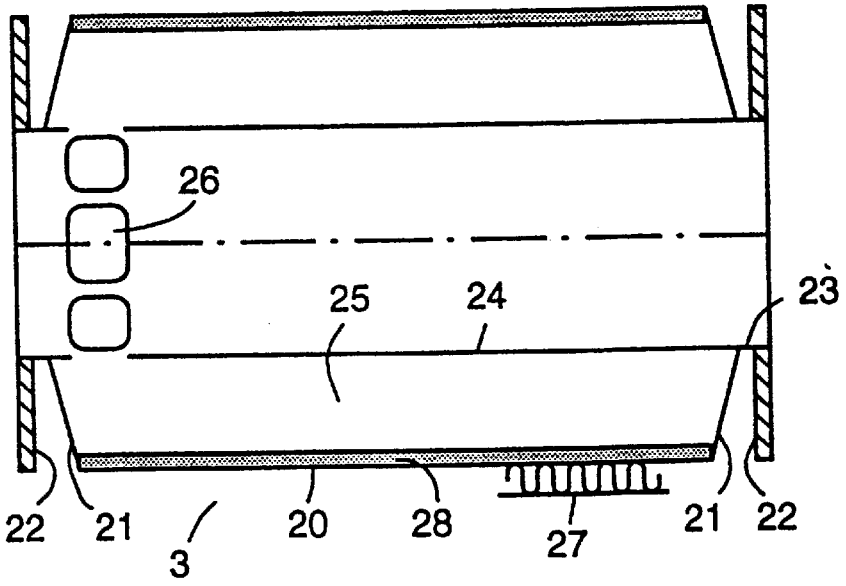
FIG. 3 shows a cross section of a reactive attenuator.

A reactive sound attenuator 3 included in the transport system is shown in FIG. 3. The sound attenuator comprises a cylindrical container 20 with a cone-shaped connection piece 21 arranged at each end. A preferably circular flange 22 for connection to a connecting unit in the system is fixed to the connection piece. The container 20, the connection piece 21 and the flange 22 are made of a heat-resistant material such as metal and preferably of stainless steel. A cylindrical conveyor tube 24, forming a passageway coinciding with the inside 23 of the flange 22, is arranged in the container 20. The ends of the tube connect to the inside of the flanges 22, whereby an enclosed volume 25 is arranged between the container 20 and the conveyor tube 24. A plurality of openings 26, connecting the volume 25 to the gas transport channel, are arranged at one end of the tube 24.

The openings 26 arranged in the conveyor tube 24 have a total opening area of substantially the same magnitude as the inner cross-section area of the conveyor tube. The extent of the openings is arranged in the tangential direction such that its extent in the longitudinal direction of the attenuator is limited. The ratio of the cross-section area of the transport channel to the cross-section area of the volume 25 of the reactive attenuator should be equal. If this area is reduced, the sound-attenuating effect becomes smaller and narrower with respect to frequency. If the area is increased, a greater and more broad-band effect instead arises. Thus, it is only the allowed overall volume that limits the power obtained. On the outside of the container 20, a temperature safety protection means 27 is arranged in the same way as for the resistive attenuator. On the inside of the container, inside the tuned volume 25, a heat insulation 28 is arranged, which also provides a certain sound attenuation. With this location, the need of heat insulation on the outside is reduced while at the same time a more broad-band reactive attenuation characteristic arises.

Although advantageous, the channel system is not limited to comprise a channel system with a circular-cylindrical cross section. The invention may, with equal result, be applied to systems with a multi-edge cross-section area as well as to systems with longitudinally bent sections.

Even when experiments have shown that a module with a combination of two reactive attenuators and one resistive attenuator exhibits very good sound-reducing properties, a combination of a reactive attenuator and two resistive attenuators results in a notable sound-reducing effect at low frequencies. The total resistive length and hence the length of the reflection attenuator in this case become half a wavelength. The reflection attenuator thus exhibits an attenuation characteristic where the attenuation at the dimensioning frequency is zero but which increases greatly upwards and downwards in the frequency direction. However, the quarter-wave attenuator included in the module has its attenuating effect concentrated at the dimensioning frequency. By cooperation between the two attenuators, an attenuating effect is thereby obtained which extends over a large frequency band.

By experiments it has also been demonstrated that each combination of at least one reflection attenuator and at least one reactive attenuator provides a good broad-band sound-reducing effect. What is determining is the ratio of the reactive length to the resistive length. For the best effect, the resistive length and the reactive length shall be substantially equal.

At the orifice of the gas transport system, a strong reflection wave arises, whereby a pressure node is located here. This situation is utilized according to the invention for placing a reactive attenuator (3*f*) with its orifice facing away from the orifice of the system. The reactive attenuator may equally be arranged such that its orifice is placed a quarter of a wavelength from the orifice of the system but that the extent of the attenuator is facing away from the orifice of the system.

What is claimed is:

1. A device for sound reduction in a transport system for gaseous medium between an inlet, which is connected to a sound source, and an outlet, the device comprising:

at least one module arranged in the transport system such that the gaseous medium passes through the at least one module, the at least one module comprising at least one reflection attenuator with a resistive length interconnected with at least one reactive attenuator with a reactive length, wherein the resistive length and the reactive length are substantially the same.

2. The device according to claim 1, wherein the at least one module comprises a reflection attenuator and a reactive attenuator interconnected on opposite sides of the reflection attenuator.

3. The device according to claim 2, wherein a first of the reactive attenuators has a reactive length of a quarter of a wavelength of a lower limit frequency of a frequency band, and a second of the reactive attenuators has a reactive length of a quarter of a wavelength of an upper limit frequency of the frequency band.

4. The device according to claim 1, wherein a ratio of the resistive length to the reactive length is 0.85 to 1.15.

5. The device according to claim 1, wherein the at least one reflection attenuator comprises a container and an absorption body arranged in the container, the at least one reflection attenuator further comprises a channel arranged between the container and the absorption body, a portion of the gaseous medium flows through the channel.

6. The device according to claim 1, wherein the at least one reactive attenuator comprises a container, a conveyor tube surrounded by the container defining a gas transport channel, a volume enclosed between the container and the conveyor tube body, the volume having a cross-sectional area substantially similar to a cross-sectional area of a gas transport channel defined by the conveyor tube.

7. The device according to claim 6, wherein the conveyor tube comprises openings extending between the volume and the gas transport channel, wherein a total cross-sectional area of the openings between the conveyor tube and the volume is substantially similar to the cross-sectional area of the conveyor tube.

8. The device according to claim 1, wherein the resistive length is one quarter of a wavelength of a center frequency of a frequency band, and the reactive length is one quarter of a wavelength of a frequency between a lower limit frequency and an upper limit frequency of the frequency band.

9. The device according to claim 1, wherein the resistive length is one half of a wavelength of a center frequency of a frequency band, and the reactive length is one quarter of a wavelength of the center frequency of the frequency band.

10. A method for sound reduction within a frequency band in a transport system for gaseous medium, the method comprising:

arranging in the transport system a device comprising at least one module that the gaseous medium passes through, the at least one module comprising at least one reflection attenuator with a resistive length of a quarter of a wavelength of a center frequency of a frequency band, the at least one module further comprising at least one reactive attenuator with a reactive length of a quarter of a wavelength of a frequency between a lower limit frequency and an upper limit frequency of the frequency band.

11. The method according to claim 10, further comprising:

providing the at least one reflection attenuator a resistive length of half a wavelength of a center frequency of a frequency band; and providing the at least one reactive attenuator a reactive length of a quarter of a wavelength of the center frequency of the frequency band.

12. The method according to claim 10, further comprising:

providing the at least one module with at least one reflection attenuator and a first reactive attenuator interconnected a first end of the at least one reflection attenuator and a second reactive attenuator interconnected with a second end of the at least one reflection attenuator;

providing the first reactive attenuator with a reactive length of a quarter of a wavelength of a lower limit frequency of a frequency band; and providing the second reactive attenuator with a reactive length of a quarter of a wavelength of an upper limit frequency of the frequency band.

13. The method according to claim 10, further comprising:

providing the at least one module with at least one reflection attenuator and a first reactive attenuator interconnected a first end of the at least one reflection attenuator and a second reactive attenuator interconnected with a second end of the at least one reflection attenuator.

14. The method according to claim 10, further comprising:

providing the resistive length and the reactive length at a ratio of 0.85 to 1.15.

15. The method according to claim 10, wherein arranging the at least one module further comprises providing the at least one reflection attenuator with a container and an absorption body arranged in the container, the at least one reflection attenuator further comprising a channel arranged between the container and the absorption body, the method further comprising directing a portion of the gaseous medium through the channel.

16. The method according to claim 10, wherein arranging the at least one module further comprises providing the at least one reactive attenuator with a container, a conveyor tube surrounded by the container defining a gas transport channel, a volume enclosed between the container and the conveyor tube body, the volume having a cross-sectional area substantially similar to a cross-sectional area of a gas transport channel defined by the conveyor tube.

17. The method according to claim 16, wherein arranging the at least one module further comprises providing the conveyor tube with openings extending between the volume and the gas transport channel, wherein a total cross-sectional area of the openings between the conveyor tube and the volume is substantially similar to the cross-sectional area of the conveyor tube.

18. An exhaust system for ships, comprising:

a device for sound reduction in a transport system for gaseous medium, wherein the system comprises at least one module arranged in the transport system such that the gaseous medium passes through the at least one module, the at least one module comprising at least one reflection attenuator with a resistive length interconnected with at least one reactive attenuator with a reactive length, wherein the resistive length and the reactive length are substantially the same.

19. A method for achieving sound reduction in an exhaust system of a ship, the method comprising:

arranging in the exhaust system a device comprising at least one module that the gaseous medium passes through, the at least one module comprising at least one reflection attenuator with a resistive length of a quarter of a wavelength of a center frequency of a frequency band, the at least one module further comprising at least one reactive attenuator with a reactive length of a quarter of a wavelength of a frequency between a lower limit frequency and an upper limit frequency of the frequency band.

* * * * *